US007555813B2

(12) United States Patent
Choi

(10) Patent No.: US 7,555,813 B2
(45) Date of Patent: Jul. 7, 2009

(54) VACUUM CLEANER AND DUST COLLECTION UNIT THEREOF

(75) Inventor: Jong Seong Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 750 days.

(21) Appl. No.: 11/099,578

(22) Filed: Apr. 6, 2005

(65) Prior Publication Data

US 2006/0037172 A1 Feb. 23, 2006

(30) Foreign Application Priority Data

Aug. 23, 2004 (KR) ..... 10-2004-0066335

(51) Int. Cl.
*A47L 9/14* (2006.01)

(52) U.S. Cl. ..... 15/353

(58) Field of Classification Search ..... 15/350–352, 15/359, 428–433, 493, DIG. 3; *A47I 09/14, A47I 09/16*

See application file for complete search history.

(56) References Cited

U.S. PATENT DOCUMENTS

2005/0015921 A1* 1/2005 Pullins ..... 15/352

FOREIGN PATENT DOCUMENTS

JP 2005095664 * 4/2005

* cited by examiner

*Primary Examiner*—David A Redding
(74) *Attorney, Agent, or Firm*—Ked & Associates, LLP

(57) ABSTRACT

Provided is a dust collection unit of a vacuum cleaner, including a dust collection container and a coupling portion formed at a concaved inside of the dust collection container, for allowing a lower cover to be selectively coupled to the dust collection container. The dust collection unit is firmly supported against an external impact, thereby enhancing the reliability of the vacuum cleaner and preventing the vacuum cleaner from being damaged.

16 Claims, 8 Drawing Sheets

VACUUM CLEANER AND DUST COLLECTION UNIT THEREOF

BACKGROUND OF THE INVENTION

1. Field of the Invention

The present invention relates to a vacuum cleaner, and particularly to a dust collection unit of a vacuum cleaner having an improved convenience in using it and an enhanced dirt filtering efficiency. Further, the invention relates to a dust collection unit of a vacuum cleaner that can improve a convenience in air exhaustion and in use of a dirt discharge structure and increase consumer satisfaction.

2. Description of the Related Art

A vacuum cleaner is generally classified into a canister vacuum cleaner and an upright vacuum cleaner. Particularly, the upright vacuum cleaner includes a main body, a nozzle unit and a handle that are integrally formed, so the vacuum cleaner itself is moved when a user pushes or pulls a handle with gripping it. At this time, dusts on the floor are sucked through the nozzle to clean the floor. A general configuration of such an upright vacuum cleaner is already well known from many documents, so its detail description is omitted.

Meanwhile, a dust collection unit is detachably installed in the main body of the vacuum cleaner. When the vacuum cleaner operates, the dust collection unit is installed in the main body of the vacuum cleaner. When a predetermined amount of dirt is accumulated in the dust collection unit, the dust collection unit is separated from the main body such that captured dirt is discharged. Inside the dust collection unit, a cyclone member capturing dirt using a cyclone way and a filtering member separating dirt using a filtering way can be formed respectively. Also, the dust collection unit is made in the form of a cylinder for smooth cyclone separation of dirt. The dust collection unit has a suction hole and an exhaust hole, which are formed at an outer circumference thereof and communicated with the main body of the vacuum cleaner.

However, since the suction hole and the exhaust hole are formed on the outer circumferential surface of the cylindrical dust collection unit, the dust collection unit as being decoupled may be frequently fractured due to impact. Also, since the dirt cover of the dust collection unit is easily opened regardless of a user's desire, the dirt collected therein may be spilt out of the dust collection unit. In addition, since the exhaust hole as being protruded is in contact with the main body of the vacuum cleaner to have a very narrow space for the formation of a sealing structure therebetween, it fails to obtain a reliable sealing.

Further, since the suction hole and/or the exhaust hole are/is protruded, the appearance is not good.

SUMMARY OF THE INVENTION

Accordingly, the present invention is directed to a dust collection unit of a vacuum cleaner that substantially obviates one or more problems due to limitations and disadvantages of the related art.

An object of the invention is to provide a dust collection unit of a vacuum cleaner in which a gap between an exhaust hole of the dust collection unit and the main body of the vacuum cleaner is firmly and reliably sealed.

Another object of the present invention is to provide a dust collection unit of a vacuum cleaner in which an exhaust hole of the dust collection unit and an opening/closing means of the exhaust hole are designed so as not to easily operate due to an external impact, thereby improving the safety in use.

A further object of the present invention is to provide a dust collection unit of a vacuum cleaner that can prevent an exhaust hole from being damaged due to unexpected external impact and provide a user with better convenience.

Further another object of the invention is to provide a dust collection unit of a vacuum cleaner of which appearance is improved to enhance a user's satisfaction.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dust collection unit of a vacuum cleaner, comprising: a dust collection container for collecting introduced foreign particles using a rotational stream of air; a lower cover for selectively opening a lower portion of the dust collection container; a hinge portion connecting the dust collection container and the lower cover such that the lower cover is opened or closed; a coupling portion for selectively latching the lower cover to the dust collection container; and an exhaust part concaved inward from an outer circumferential surface of the dust collection container and having the coupling portion in the concaved inside.

According to another aspect of the present invention, there is provided a dust collection unit of a vacuum cleaner, comprising: a dust collection container collecting foreign particles introduced by a rotational operation of air; an upper cover shielding an upper side of the dust collection container; a lower cover shielding a lower side of the dust collection container such that the foreign particles are collected thereon; a hinge portion connecting the dust collection container and the lower cover such that the lower cover is opened or closed; a discharge hole through which the air that the foreign particles are filtered by the dust collection container is discharged; an exhaust part concaved inward from an outer circumferential surface of the dust collection container and formed at an inner portion of the concaved portion; and a coupling portion for selectively latching the lower cover to the dust collection container.

According to another aspect of the present invention, there is provided a vacuum cleaner comprising: a suction nozzle unit through which outer air is sucked; a body receiving at least a motor and a suction fan; a manipulation handle formed at an upper portion of the body, for manipulating the vacuum cleaner; a dust collection unit selectively received in the body and through which air that sucked from the body and filtered is discharged; a dust collection unit seat concaved at a front of the body such that the dust collection unit is mounted; a protruded suction unit protruded from an inner surface of the dust collection unit seat, for introducing air discharged from the dust collection unit into the body; and an exhaust part concaved at an outer circumferential surface of the dust collection unit, for receiving the protruded suction unit.

According to another aspect of the present invention, there is provided a dust collection unit of a vacuum cleaner, comprising: a dust collection container separating and collecting foreign particles using a rotational stream of air containing introduced dust; a lower cover for selectively opening or closing a lower portion of the dust collection container; a hinge portion connecting the dust collection container and the lower cover such that the lower cover is opened or closed; and a coupling portion for selectively latching the lower cover to the dust collection container, wherein the hinge portion and/or the coupling portion are disposed at an inwardly concaved portion of the dust collection container.

According to the present invention, a gap between the exhaust part of the dust collection unit and the main body of the vacuum cleaner is firmly and reliably sealed, so that a suction efficiency of foreign particles can be enhanced.

Also, since the exhaust hole of the dust collection unit and the opening and closing means of the exhaust hole are not shaken by an external impact, convenience in use is enhanced.

Further, the exhaust hole of the dust collection unit and the opening and closing means of the exhaust hole are not damaged by an unexpected external impact and a convenient handling of the vacuum cleaner will be possible.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
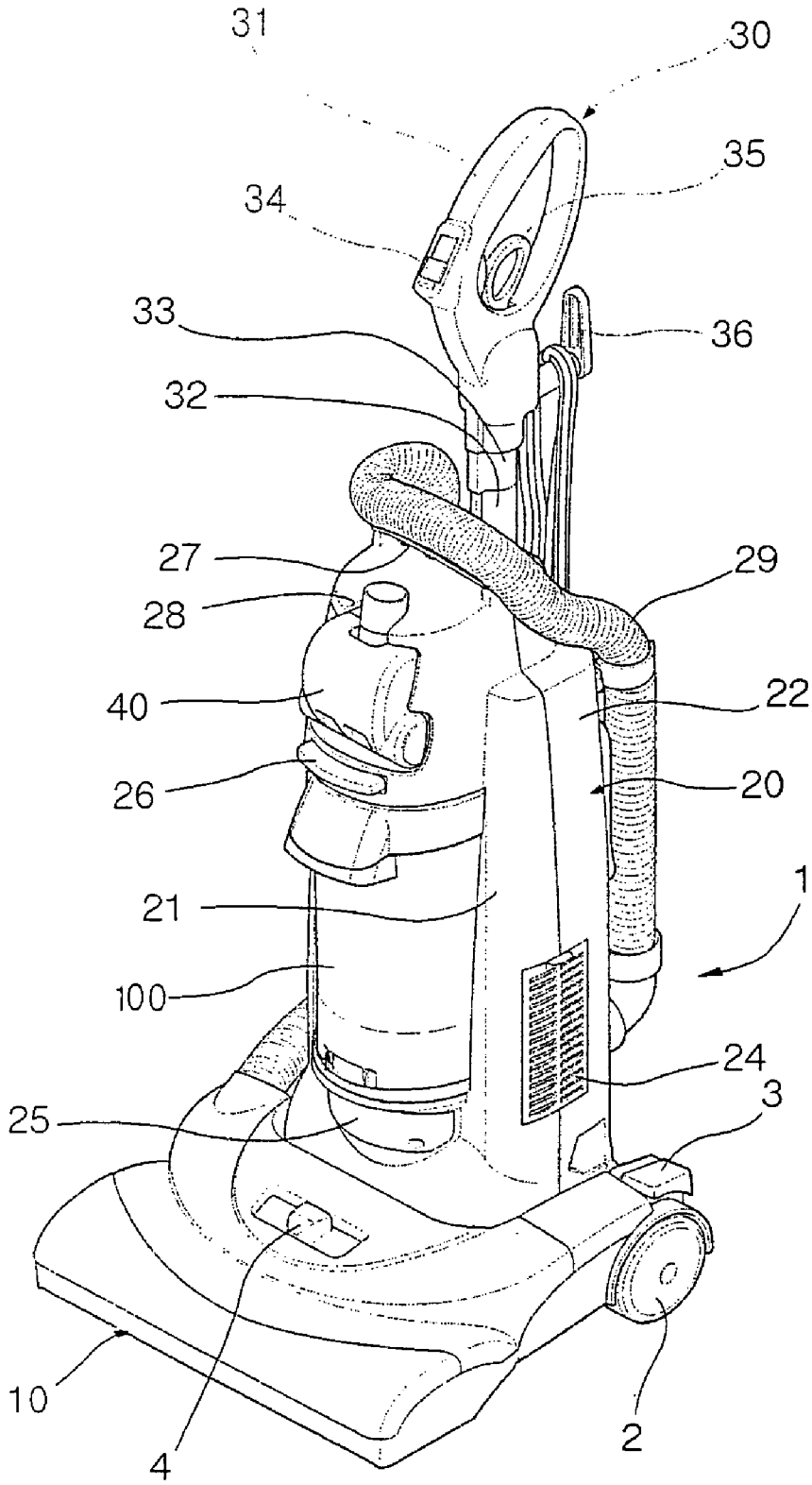
FIG. 1 is a front perspective view of an upright vacuum cleaner according to the present invention.
Figure 2:
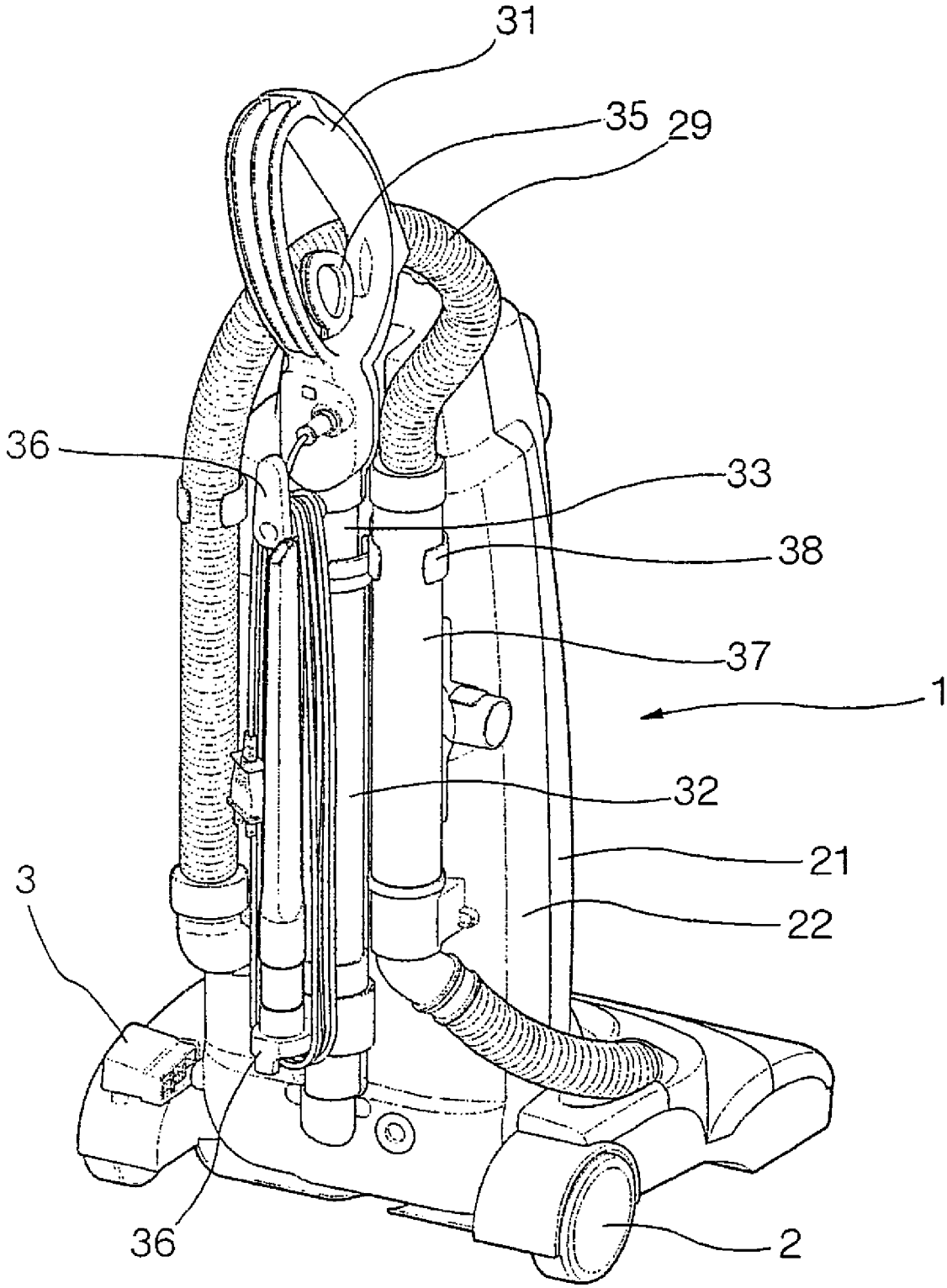
FIG. 2 is a rear perspective view of an upright vacuum cleaner according to the present invention.

FIG. 1 is a front perspective view of an upright vacuum cleaner according to the present invention, and FIG. 2 is a rear perspective view of the upright vacuum.

Referring to FIGS. 1 and 2, the upright vacuum cleaner 1 macroscopically includes a suction nozzle unit 10 contacts with a floor to suck outer air, a body 20 in which main parts including a suction motor and a fan are mounted, and a manipulation handle 30 formed on an upper portion of the vacuum cleaner such that the vacuum cleaner is moved in an easy way during the cleaning work. The cleaning work using the vacuum cleaner is conducted as follows. First, air is sucked through the suction nozzle unit 10 together with foreign particles. The foreign particles are separated from the sucked air while passing through the body 20 and cleaned, and then the cleaned air is exhausted through a predetermined discharge hole. In addition, in order to move the vacuum cleaner to a desired position, a user grips the manipulation handle 30 of the vacuum cleaner and then pulls or pushes the vacuum cleaner 1.

In detail, the suction nozzle unit 10 is used for sucking outer air and has a substantially rectangular shape with an opening opened toward the floor. The suction nozzle unit 10 is hinged to the body 20, and a pivoting lever 3 controls this hinge movement. In addition, for better movement of the suction nozzle unit 10, the suction nozzle unit f10 further includes wheels 2 installed at a rear portion of the suction nozzle unit 10, and a height control knob 4 installed on an upper surface of the suction nozzle unit 10 for height control of the suction nozzle unit 10. The air sucked into the suction nozzle unit 10 is guided to the body 10 by means of a hose 29. For this purpose, both ends of the hose 29 are connected to the suction nozzle unit 10 and the body 20, respectively.

In detail, the body 20 includes a front case 21 for protecting a front portion of the body 20 and a rear case 22 for protecting a rear portion of the body 20, and the front and rear portions are fixed with each other by a certain manner such as fitting or screwing. Furthermore, the body 20 is provided with a dust collecting unit 100 for collecting dusts from the air sucked through the hose 29, a detachable lever 26 for separating the dust collecting unit 23 from the body 20 in a convenient way, a discharge cover 24 formed in a side of the body 20 for allowing the air free from foreign particles to be discharged, a lamp 25 for lighting the floor at night so that the vacuum cleaner may be manipulated in a convenient way, a mini nozzle seat 28 concaved in the top of the front case 21, and a mini nozzle 40 selectively received in the mini nozzle seat 28. The mini nozzle 40 may be used for cleaning places that are not directly contacted with the main body of the upright cleaner like a corner and received in the mini nozzle seat 28 during a custody time. Inside the dust collection unit 100, a cyclone type dust collection member capturing foreign particles using a cyclone way and a filtering type dust collection member separating foreign particles using a filtering way can be formed respectively. The two dust collection members are disposed inside the body 20.

In addition, the body 20 is also provided on its rear side with a code hook 36 protruded at upper and lower positions of the body 20 so that a power line is wound kept in custody thereon, a hose guide 37 that configures at least a part of the hose 29 and is made of strong materials unlike the hose 29, and a holder 38 protruded on the rear side of the body 20 so as to support the hose guide 37. The hose guide 37 is used for convenient positioning of the mini nozzle 40 when the mini nozzle is used in connection to the hose 29.

Meanwhile, to the hose guide 27, another suction nozzle unit like the mini nozzle 40 may be conveniently connected. For this purpose, one end of the hose guide 37 connected to the hose 29 is easily separated, and then another suction nozzle unit such as the mini nozzle 40 may be connected thereto. In addition, the hose 29 has a bellows shape, so its length may be shortened while being kept in custody and elongated over five times when being used by a user. Thus, the hose 29 allows a user to clean a place far away from the main body of the vacuum cleaner.

In addition, at the top of the front case 21, the hose 29 may be seated in a shrunk state, and a moving handle 27 is formed for a user to grip to carry the vacuum cleaner. The moving handle 27 may be used not only for holding and carrying the vacuum cleaner but also for holding the hose 29.

In detail, the manipulation handle 30 includes a handle 31 for a user to grip conveniently while the vacuum is operating, and an operation switch 34 formed at a predetermined position of the handle 31 and used for controlling operation of the vacuum cleaner itself such as initiation of operation of the vacuum switch and suction force of the vacuum cleaner. In addition, a length of the manipulation handle 30 may be conveniently adjusted. In more detail, for adjustment of length, the manipulation handle 30 includes an extension pipe 33 extended downward to the handle 31, and a fixed pipe 32 that supports the extension pipe 33 and allows the extension pipe 33 to be moved through it by means of selective manipulation of an extension lever 35 so that the length of the manipulation handle 30 may be shortened or elongated.

The present invention mainly has an interest on the dust collection unit 100, particularly on improved convenience in use of the dust collection unit 100. The dust collection unit 100 communicates with the body 20 to suck unfiltered air and exhaust filtered clean air toward the body 20. Hereinafter, the structure and operation of the dust collection unit will be described with reference to the accompanying drawings.

Figure 3:
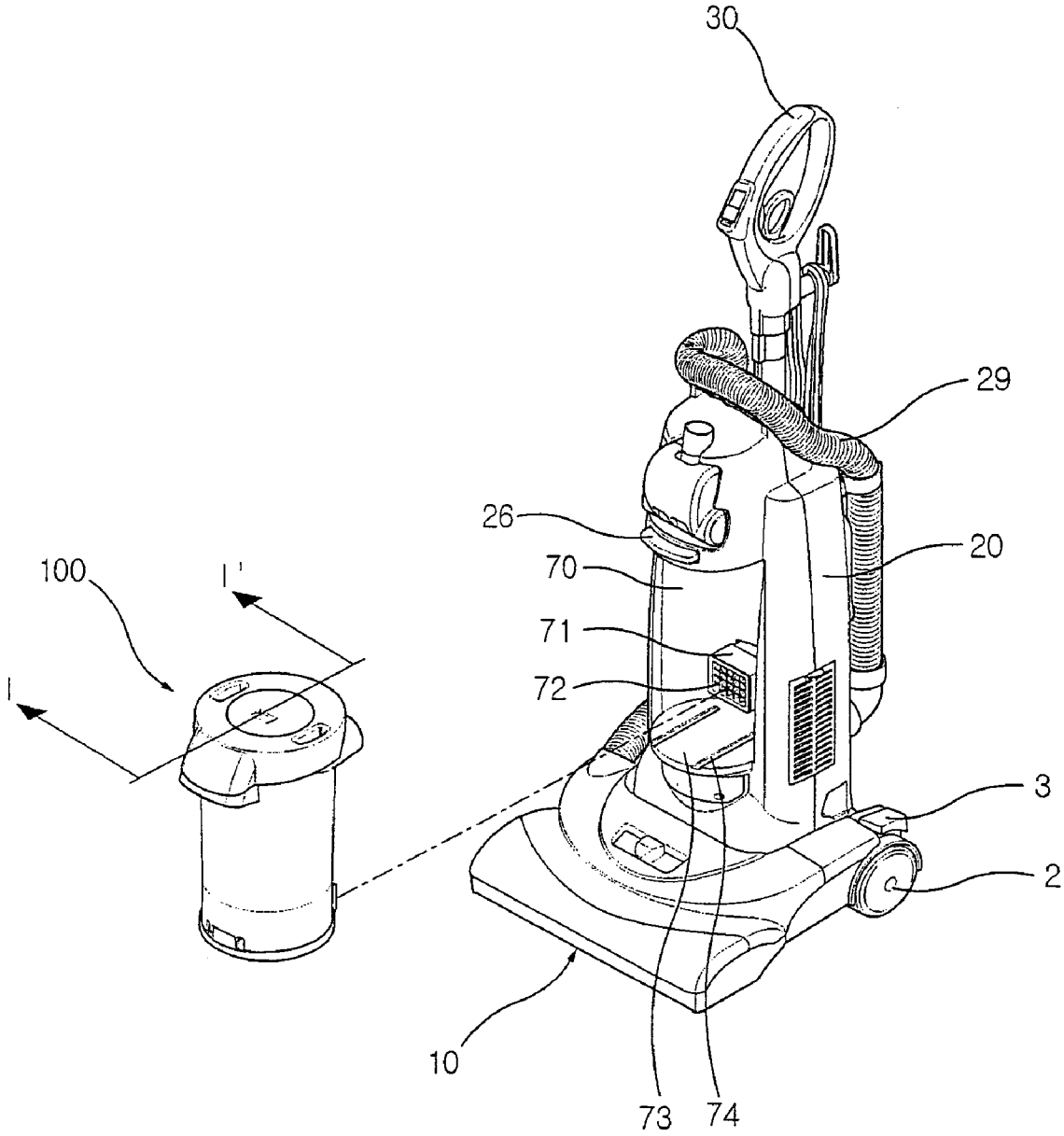
FIG. 3 is an exploded perspective view showing a state of when a dust collection unit is disassembled from a vacuum cleaner of the present invention.

FIG. 3 is an exploded perspective view showing a state of when the dust collection unit is disassembled from a vacuum cleaner of the present invention.

Referring to FIG. 3, the body 20 is provided therein with a motor (not shown) for generating a suction force and a suction fan (not shown) rotating using a power of the motor such that outer air and foreign particles are sucked through the suction nozzle unit 10. A dust collection unit seat 70 is formed at a central portion of the body 20. The dust collection unit seat 70 is concaved toward an inside of the body 20 from a front side of the body 20 such that the dust collection unit 100 is inserted into and installed at the dust collection unit seat 70.

In detail, a suction unit 71 that is an air introduction path is formed protruding from a rear surface of the dust collection unit seat 70. The suction unit 71 communicates with a discharge hole (see 165 of FIG. 6) of the dust collection unit 100. Therefore, the air introduced into the dust collection unit 100 from the body 20 is filtered at the dust collection unit 100 and then is again introduced into the inside of the body through the suction unit 71. The suction unit 71 is protruded so as to be exactly aligned with the discharge hole 165 because the discharge hole 165 of the dust collection unit 100 is concaved toward an inside of the dust collection unit 100.

A filter 72 is attached on a front surface of the suction unit 71 to filter foreign particles contained in air introduced thereinto. In particular, the filter 72 filters foreign particles which were not filtered by the dust collection unit 100 and introduced into the inside of the body 20, thereby preventing components such as a motor (not shown) built in the body 20 from being damaged. In addition, the dust collection unit seat 70 includes a pair of guide grooves 74 formed in a bottom surface 73 thereof in a front and rear direction thereof. The pair of guide grooves 74 are aligned with guide protrusions (not shown) formed at a lower surface of the dust collection unit 100 such that the dust collection unit 100 is exactly inserted into the dust collection unit seat 70. Of course, the bottom surface 73 of the dust collection unit seat 70 supports the weight of the dust collection unit 100.

The dust collection unit 100 seated on the dust collection unit seat 70 of the body 20 is shaped in a cylinder such that foreign particles are filtered by a cyclone way. The dust collection unit 100 filters foreign particles contained in the air sucked through the suction nozzle unit 10 and it is detachably assembled in the dust collection unit seat 70. The dust collection unit 100 can collect foreign particles therein using a general cyclone way, using a separate filter, or using the cyclone and the filter at the same time.

The body is further provided at a front surface thereof with the detachable lever 26. The detachable lever 26 moves up and down centering on a hinge shaft (not shown). One end of the detachable lever 26 is latched on a detachable groove (see 142 of FIG. 4) of the dust collection unit 100. Accordingly, the detachable lever 26 is used to fix an upper side of the dust collection unit 100, or is used to separate the dust collection unit 100 as a user manipulates the detachable lever 26 to release the latch between the detachable groove 142 and the dust collection unit 100.

Next, inner construction of the dust collection unit 100 according to the spirit of the present invention will be described in detail with reference to accompanying drawings.

Figure 4:
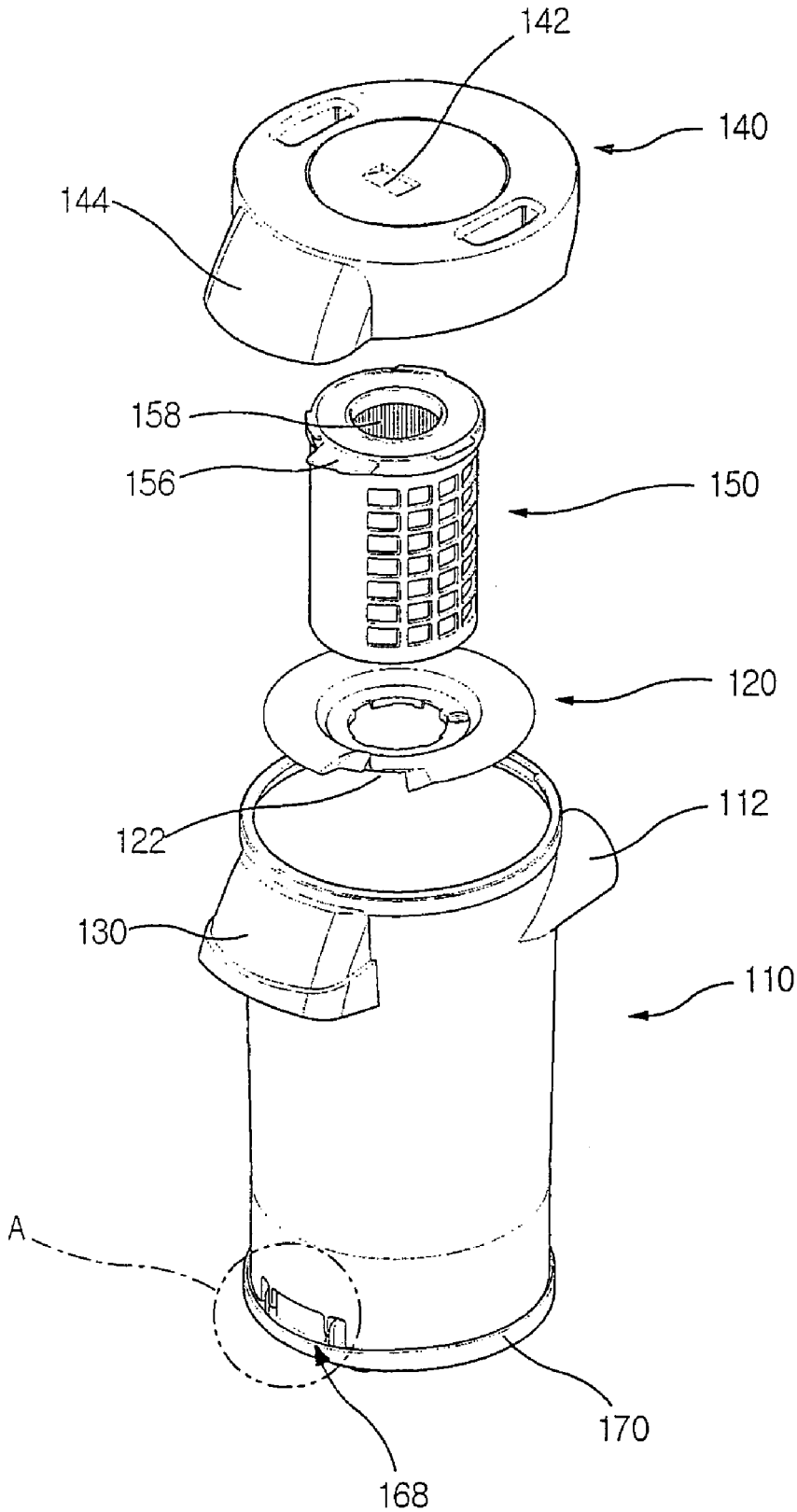
FIG. 4 is a disassembled perspective view of the dust collection unit.
Figure 5:
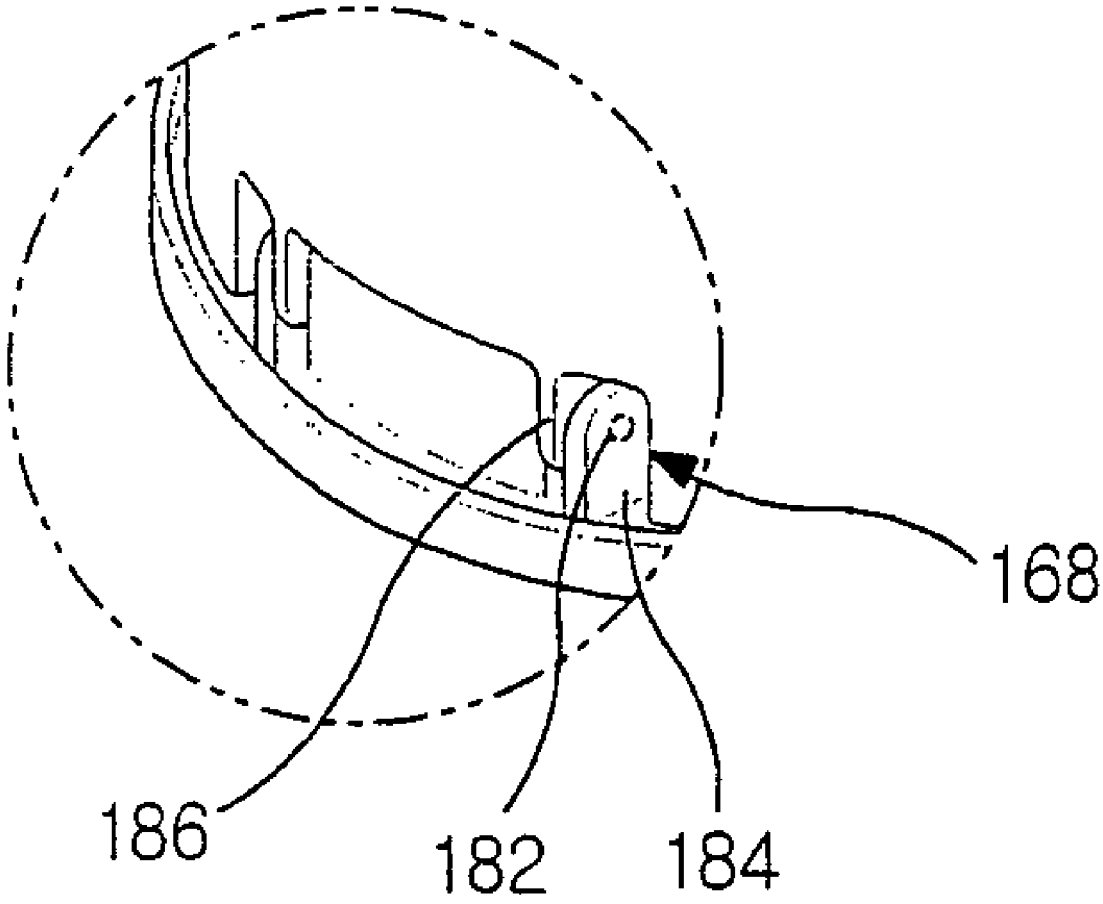
FIG. 5 is a detailed view of portion 'A' of FIG. 4.
Figure 6:
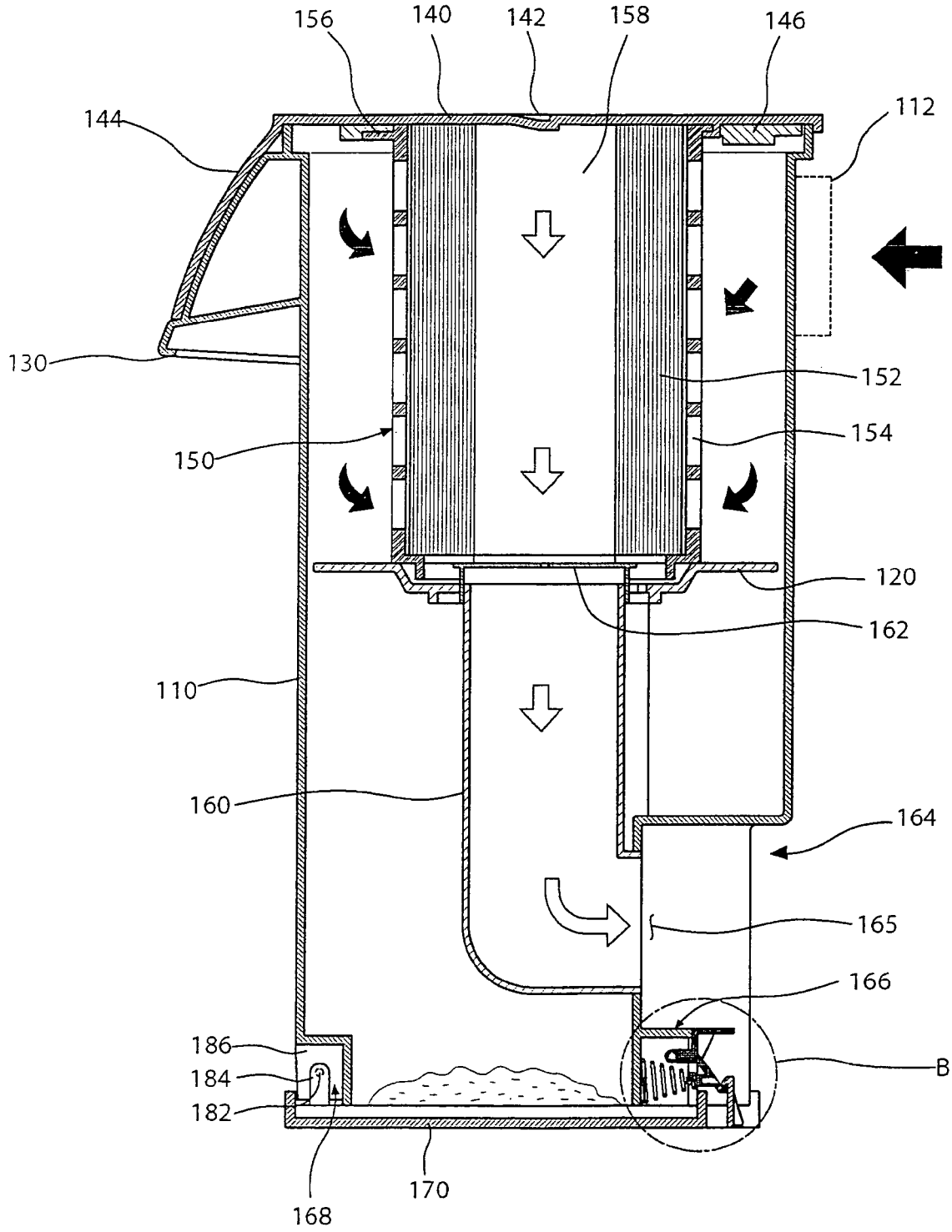
FIG. 6 is a sectional view taken along the line I-I' of FIG. 3.

FIG. 4 is a disassembled perspective view of the dust collection unit, FIG. 5 is a detailed view of portion 'A' of FIG. 4, and FIG. 6 is a sectional view taken along the line I-I' of FIG. 3.

Referring to FIGS. 4 through 6, the dust collection unit 100 includes a cylindrical dust collection container 110 forming the appearance of the dust collection unit 100. A suction guide 112 is formed at an upper side portion of the dust collection container 110. The suction guide 112 is protruded outward from the dust collection container 110 to guide the air introduced into the dust collection container 110 such that the air flows in a tangential direction along an inner wall of the dust collection container 110. Accordingly, the suction guide 112 is protruded along the tangential direction of the dust collection container 110. Also, the cylindrical shape of the dust collection container 110 is used for rotating the sucked air.

Inside the dust collection container 110, a separation plate 120 is disposed to separate foreign particles having a relatively high weight in the foreign particles contained in the introduced air at a lower side of the dust collection container 110. Inner space of the dust collection container 110 is partitioned into an upper space and a lower space by the separation plate 120. The separation plate 120 is formed having an outer diameter smaller than an inner diameter of the dust collection container 110 such that the foreign particles drop. In addition, the separation plate 120 has a communication hole 122 formed in a vertical direction to guide a downward drop of the separated foreign particles. In other words, the foreign particles contained in the air passes through the communication hole 122 of the separation plate 120 and are moved downward. Also, the separation plate 120 has a central portion concaved by a predetermined depth so as to mount a filter assembly 150 thereon.

In addition, a handle 130 is formed at the other outer circumferential surface of the suction guide 112. The handle 130 is protruded toward a lateral direction from an upper portion of the dust collection container 110 to allow a user to separate and couple the dust collection unit 100 from the body 20 with ease.

Also, an upper surface of the dust collection container 110 is shielded by an upper cover 140. The upper cover 140 is openably and closably installed at an upper side of the dust collection container 110. The upper cover 140 has a detachable groove 142 formed downward at an upper central portion thereof. A rear end of the detachable lever 26 is latched on the detachable groove 142. The upper cover 140 also includes a handle cover 144 formed at a side portion thereof, for covering the handle 130. The handle cover 144 is formed in a shape corresponding to the appearance of the handle 130. A filter lever 146 for fixing a filter assembly 150 is disposed below the upper cover 140. The filter lever 146 is installed movably with a freedom in one direction to selectively fix a coupling rib 156 of the filter assembly 150, thereby controlling separation and coupling of the filter assembly 150.

The filter assembly 150 is installed below the upper cover 140. The filter assembly 150 is made in the shape of a cylinder, to filter foreign particles contained in sucked air. Preferably, the filter assembly 150 is made in a dual structure so as to completely filter the foreign particles. In detail, the filter assembly includes a bellows filter 152 having a bellows repeated in a vertical direction, and a net filter 154 disposed on an outer surface of the bellows filter 152. The coupling rib 156 is protruded toward the lateral direction from the upper portion thereof. The coupling rib 156 is selectively coupled with the filter lever 146 provided in the upper cover 140. Accordingly, when the coupling rib 156 is latched on the filter lever 146, the filter assembly 150 is fixed to the upper cover 140. The filter assembly 150 is further provided at a central portion thereof with a discharge guide passage 158 formed in a vertical direction. The discharge guide passage 158 guides a downward discharge of the air that has passed through the filter assembly 150. Therefore, the air that has passed through the net filter 154 and the bellows filter 152 is guided by the discharge guide passage 158 and is moved downward.

Also, a discharge guide pipe 160 is formed along a lower central portion of the separation plate 120. The discharge guide pipe 160 has a lower end bent toward a side direction and is finally made in the form of '└'. The discharge guide pipe 160 guides the air discharged through the discharge guide passage 158 of the filter assembly 150 toward a lower side direction of the dust collection container 110. Accordingly, the discharge guide pipe 160 has a circular inner circumference and a top end having an inner diameter that is at least equal to or larger than an inner diameter of the discharge guide passage 158.

Also, a foreign particle shielding film 162 is disposed at an upper end of the discharge guide pipe 160. The foreign particle shielding film 162 is made of a flexible material such as rubber, and is shaped in a radially cutaway structure so as to make flow easy. The foreign particle shielding film 162 prevents the foreign particles attached on the filter assembly 150 from dropping and being introduced into the inside of the discharge guide pipe 160 when the filter assembly 150 is separated upward together with the upper cover 140. In addition, since the foreign particle shielding film 162 is made of a flexible material, it is curved downward along the airflow while the dust collection unit 100 operates and accordingly has no influence on the operation of the dust collection unit 100.

In addition, the dust collection unit has an exhaust part 164 formed at a rear side thereof. The exhaust part 164 is to guide discharge of air flowing through the discharge guide pipe 160 and it receives the protruded suction unit 71 of the body 20. In other words, the protruded suction unit 71 is protruded forward from the inner circumferential surface of the dust collection unit seat 70 of the body 20 and the exhaust part 164 is concaved forward by a predetermined portion from a rear surface of the dust collection container 110 so as to receive therein the protruded suction unit 71. The exhaust part 164 has a discharge hole 165 through which air flowing through the discharge guide pipe 160 is discharged. The discharge hole 165 is preferably formed in the shape of a rectangle to correspond to the protruded suction unit 71. Of course, it is preferable that the discharge hole 165 is exactly in contact with an end of the protruded suction unit 71 such that the air flowing therein is completely sealed.

In addition, the dust collection unit further includes a lower cover 170 which is freely openable and closable. The lower cover 170 is to remove the foreign particles collected in the dust collection unit 100. The lower cover 170 is provided at a predetermined portion thereof with a hinge portion 168 such that the lower cover 170 is rotatable with respect to the dust collection container 110, and further provided at another predetermined portion thereof with a coupling portion 166 such that the lower cover 170 is fixed to the dust collection container 110. Since the coupling portion 166 is formed inside the exhaust part 164 concaved from the rear surface of the dust collection container 110, it is not observed by a user manual eye, resulting in the enhancement in the appearance. Of course, since the coupling portion 16 is received inside the dust collection container 110 so as not to be in contact with external impact, unexpected damage can be prevented. Of course, in another aspect, since the lower side of the dust collection container 110 is smaller in width than the upper side due to the existence of the exhaust part 164, the lower cover 170 has a smaller width than the upper cover 140.

The hinge portion 168 will now be described in detail with reference to FIG. 5.

The hinge portion 168 includes a hinge shaft 182 serving as a rotational center of the lower cover 170, a cover supporting portion 184 allowing the hinge shaft 182 to be rotatably supported with respect to the lower cover 170, and a dust collection container supporting portion 186 allowing the hinge shaft 182 to be rotatably supported with respect to the dust collection container 110. The cover supporting portion 184 is protruded upward from a front end of the lower cover 170 to support the hinge shaft 182, and the dust collection container supporting portion 186 is protruded downward from a lower surface of the dust collection container 110. By doing so, the cover supporting portion 184 and the dust collection container supporting portion 186 are rotatable with respect to each other centering on the hinge shaft 182. Also, since the hinge portion 168 is concaved inward by a predetermined depth with respect to the outer circumferential surface of the dust collection container 11, it is endurable against external impact like the coupling portion 166 and decreases inconvenience in use.

Figure 7:
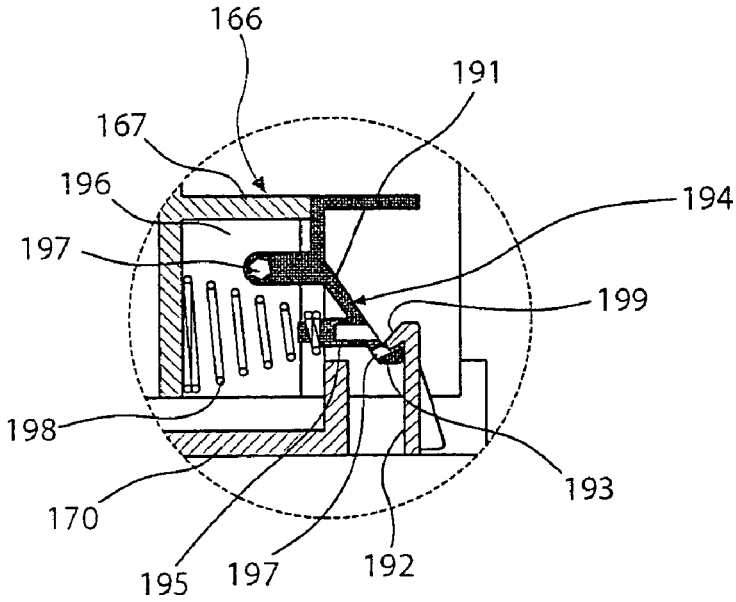
FIG. 7 is a detailed view of portion 'B' of FIG. 6.
Figure 8:
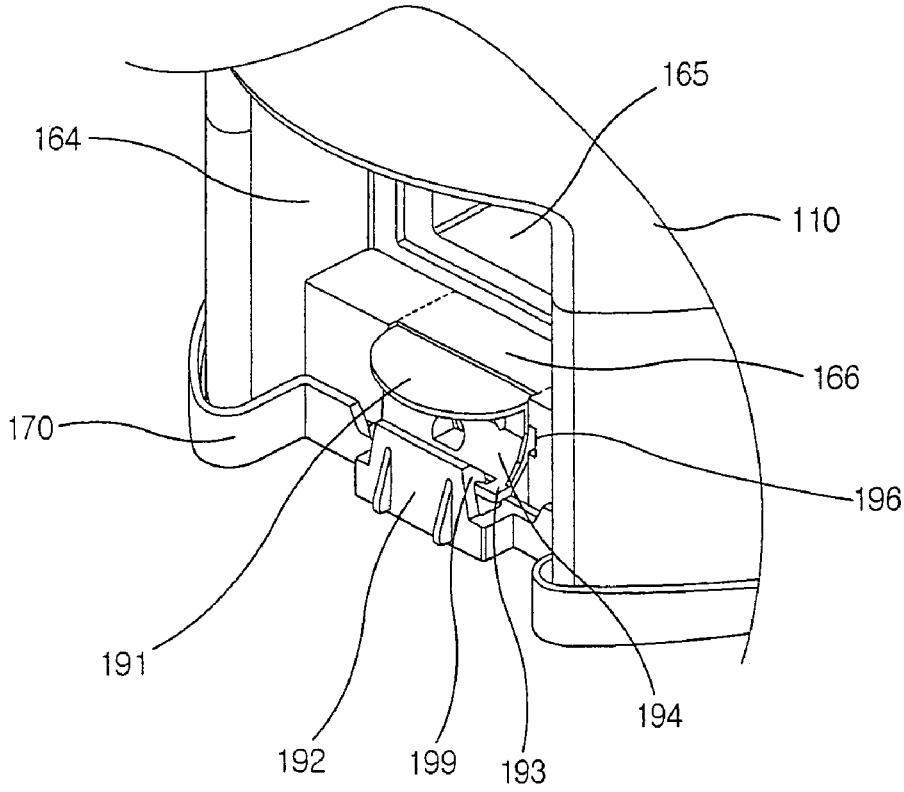
FIG. 8 is a detailed perspective view of the coupling portion.

The coupling portion will now be described in detail with reference to the detailed view of FIG. 7 and the detailed perspective view of FIG. 8. First, as aforementioned, the exhaust part 164 is formed by concaving a rear portion of the lower cover 170 by a predetermined depth. A latch protrusion 192 is disposed at an inner side portion of the exhaust part 164. Accordingly, the latch protrusion 192 is positioned at a relatively inner portion compared with the outer circumferential surface of the dust collection container 110. The latch protrusion 192 is protruded upward by a predetermined portion from the lower cover 170, and an upper end of the latch protrusion 192 is bent forward to form a latch jaw 199.

Also, a latch hook 194 on which the latch jaw 199 is selectively latched to support the position of the lower cover 170 is installed. The latch hook 194 is rotatably installed at an axial supporting terminal 196 formed at left and right of the coupling portion 166. For this purpose, a rotational shaft 197 extending in a lateral direction of the latch hook 194 is formed. In other words, the rotational shaft 197 is integrally protruded in a lateral direction and is rotatably inserted into the axial supporting terminal 196. The latch hook 194 includes a push portion 191 curvedly formed at an upper end thereof and extending in a rear direction thereof. The push portion 191 is a portion pushed by a user's finger. When the push portion 191 is pushed, the latch hook 194 rotates centering on the rotational shaft 197. In addition, the coupling portion further includes a protruded portion 167 supporting one end of the push portion 191 to limit an overall rotational movement of the latch hook 194 when a user's external force is not applied. The protruded portion 167 is protruded from a side portion of the dust collection container 110.

In addition, the latch hook 194 includes a plurality of branches formed at a lower end thereof. The latch hook 194 includes a latch end portion 193 that is bent rearward. The latch end portion 193 corresponds to a portion where the latch jaw 199 of the latch protrusion 192 is coupled, and includes a latch groove 197 penetrated in a front and rear direction. The latch jaw 199 is inserted into the latch groove 197. In order for the latch jaw 199 to be exactly latched, a lower surface of the latch groove 197 is preferably inclined corresponding to a lower surface of the latch jaw 199. In other words, when the lower surface of the latch groove 197 and the lower surface of the latch jaw 199 are correspondingly inclined downward by a predetermined slope as it travels to a front side, the latch between the latch groove 197 and the latch jaw 199 is more firmed. Accordingly, even when an external impact is applied to the latch groove 197 or the latch jaw 199, the latch jaw 199 is not separated from the latch groove 197. By doing so, the lower cover 170 can be prevented from being arbitrarily separated due to external impact.

Also, an installation protrusion 195 protruded in a front direction is formed at a front side of the latch hook 194. The installation protrusion 195 is shaped in a cylinder, and is provided with a restoring spring 198. The restoring spring 198 is preferably made of a compression spring having a predetermined elasticity and has a diameter, which is increased as it travels to a front side. Therefore, a rear end of the restoring spring 198 is fixed to the installation protrusion 195 and a front end is in contact with the dust collection container 110. Also, although not shown in the drawings, the dust collection container 110 may further include a fixing member for fixing the restoring spring. The restoring spring 198 returns to an original position after the latch hook 194 rotates clockwise.

Hereinafter, operations of the dust collection unit of the vacuum cleaner constructed as above will be described. First, as the vacuum cleaner 1 starts to operate, the motor (not shown) built in the body 20 is driven to generate a suction force. By the generated suction force, outer air and foreign particles are sucked through the suction hole (not shown) formed at the lower surface of the suction nozzle unit 10 and are then introduced into the inside of the dust collection unit 100 through the suction guide 112 of the dust collection unit 100 via the body 20.

The air and foreign particles introduced into the dust collection container 110 rotate in a radial direction and then drop downward through the communication hole 122 of the separation plate 120. The foreign particles transferred toward the downward direction of the separation plate 120 continue to rotate and are then transferred to the exhaust part 164. The rotational movement of the foreign particles is stopped by the exhaust part 164 and then the foreign particles are collected in the inside of the dust collection container 110. Thus, the foreign particles are piled up on the upper surface of the lower cover 170 by the aforementioned cyclone operation, and the air performing the radial movement above the separation plate 120 is filtered to remove the foreign particles while passing through the filter assembly 150. Thereafter, the filtered air is moved to the discharge guide passage 158 inside the filter assembly 150 and is then guided downward.

The air guided downward through the discharge guide passage 158 passes through the foreign particles shielding film 162 and is then discharged to an outside of the dust collection unit 100 through the discharge guide pipe 160 and the discharge hole 165. The air discharged to the outside of the dust collection unit 100 through the discharge hole 165 is introduced into the protruded suction unit 71 of the body 20 and is then exhausted to an outside of the vacuum cleaner via the motor (not shown). The above operation of the vacuum cleaner is shown in detail in FIG. 6.

Meanwhile, in order to remove the foreign particles collected on the upper surface of the lower cover 170 of the dust collection unit 100, it is required that the dust collection unit 100 be separated from the body 20 and the lower cover 170 be opened. The above operation will now be described with reference to FIGS. 3 through 9.

To separate the dust collection unit 100 from the body 20, the detachable lever 26 is pushed downward. When the detachable lever 26 is pushed downward, the rear end of the detachable lever 26 is extracted from the detachable groove 142 of the dust collection unit 100. Accordingly, when the handle 130 of the dust collection unit 100 is gripped and pulled forward, the dust collection unit 100 is separated from the body 20.

Figure 9:
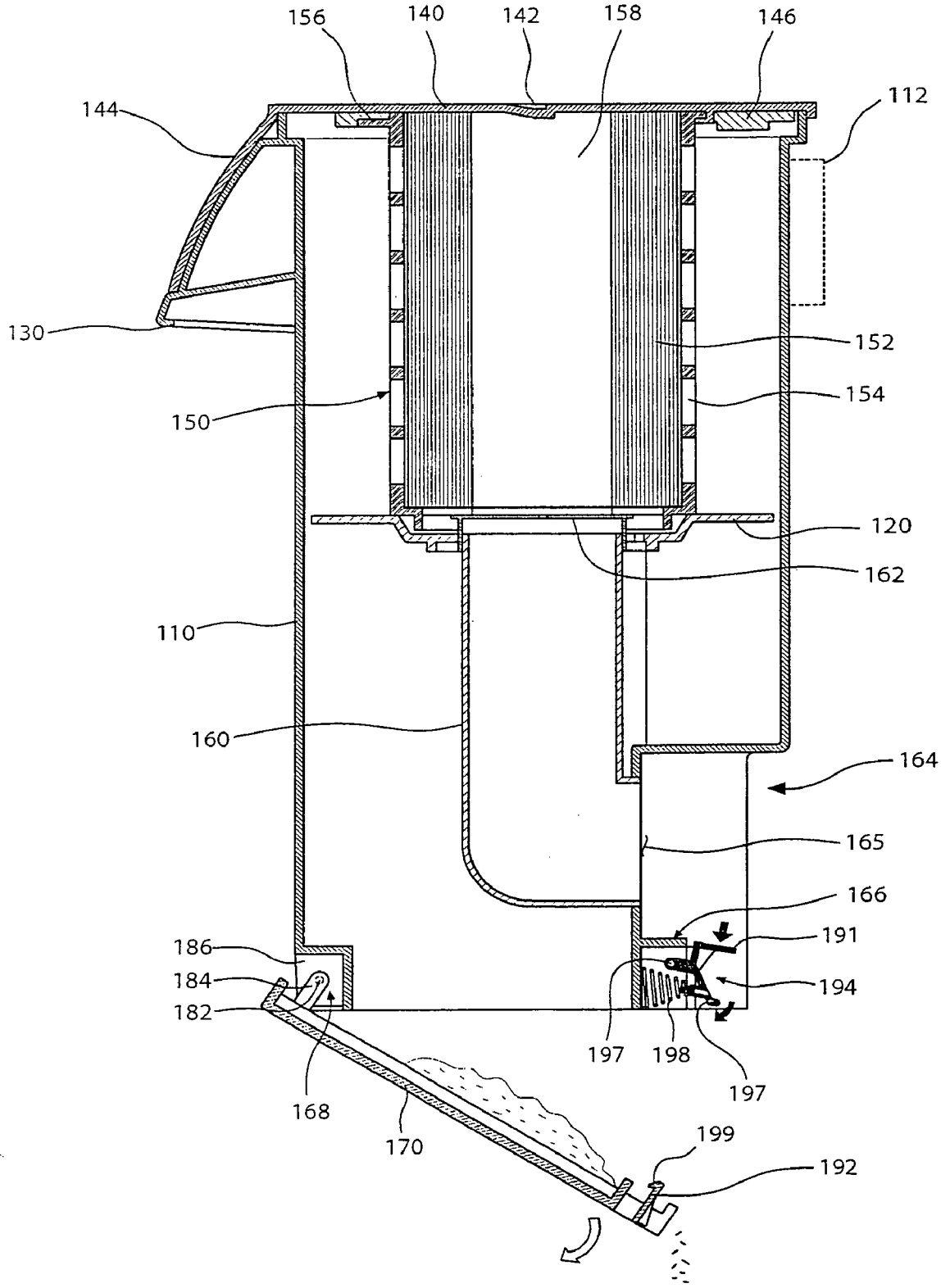
FIG. 9 is a schematic view illustrating a state of when a lower cover is opened in the dust collection unit.

After the dust collection unit 100 is separated, the lower cover 170 is separated. At this time, a user holds the handle 130 using one hand and pushes the push portion 191 downward that is the upper end of the latch hook 194 using the other hand. By doing so, the latch hook 194 rotates centering on the rotational shaft 197, so that the latch end portion 193 rotates clockwise. Thus, as the latch end portion 193 rotates, the right portion of the lower cover 170 moves downward. In other words, the right portion of the lower cover 170 rotates centering on the hinge portion 168 of the left portion and moves downward. Thus, as the lower cover 170 is opened, the dust piled up on drops downward and is then removed as shown in FIG. 9 illustrating the state of when the lower cover 170 is opened.

After the lower cover 170 is opened, as the user removes the power applied to the push portion 191, the push portion 191 is pushed counterclockwise by the restoring force of the restoring spring 198 and returns to the original position.

To couple the lower cover 170, the right portion of the lower cover 170 is lifted up to closely contact the right portion of the dust collection container 110. At this time, the latch protrusion 192 is in contact with a lower surface of the latch end portion 193 of the latch hook 194. As the lower cover 170 continues to be pushed up by a stronger force than the compressive force of the restoring spring 198, the latch jaw 199 of the latch protrusion 192 and the latch end portion 193 of the latch hook 194 are slid by a predetermined length and then the latch hook 194 is coupled with the latch protrusion 192.

After the lower cover 170 is coupled to the dust collection container 110, the dust collection unit 100 is installed at the dust collection unit seat 70 of the body 20 with holding the handle 130 of the dust collection unit 100. At this time, the guide protrusions (not shown) formed in the lower cover 170 of the dust collection unit 100 are slid along the guide grooves 74 formed in the bottom surface 73 of the dust collection unit seat 70.

After the dust collection unit 100 is installed at the dust collection unit seat 70 by the above operations, the rear end of the detachable lever 26 is inserted into the detachable groove 142 to fix the dust collection unit 100 and the protruded suction unit 71 of the dust collection unit seat 70 is inserted into and is closely in contact with the exhaust part 164 of the dust collection unit 100.

According to the dust collection unit of the vacuum cleaner provided in the present invention, a gap between the exhaust part of the dust collection unit and the main body of the vacuum cleaner is firmly and reliably sealed, so that a suction efficiency of foreign particles can be enhanced.

Also, since the exhaust hole of the dust collection unit and the opening and closing means of the exhaust hole are not shaken by an external impact, convenience in use is enhanced.

Further, the exhaust hole of the dust collection unit and the opening and closing means of the exhaust hole are not damaged by an unexpected external impact and a convenient handling of the vacuum cleaner will be possible. Furthermore, the appearance of the vacuum cleaner is improved to increase the consumer's satisfaction.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dust collection unit of a vacuum cleaner, comprising:

a dust collection container separating foreign particles contained in air including introduced dust using a rotational stream of the air to collect the separated foreign particles;

a lower cover for selectively opening a lower portion of the dust collection container;

a hinge portion connecting the dust collection container and the lower cover such that the lower cover is opened or closed;

a coupling portion for selectively latching the lower cover to the dust collection container; and an exhaust part concaved inward from an outer circumferential surface of the dust collection container and having the coupling portion in the concaved inside.

2. The dust collection unit according to claim 1, wherein the hinge portion and the coupling portion are disposed facing each other.

3. The dust collection unit according to claim 1, wherein the coupling portion comprises:

a latch protrusion extending toward an upper direction of the lower cover; and a latch groove rotating with respect to the dust collection container such that the latch protrusion is latched.

4. The dust collection unit according to claim 1, further comprising a handle formed at a portion of the dust collection container facing the coupling portion.

5. The dust collection unit according to claim 1, further comprising a discharge hole formed at an inner surface of the exhaust part, through which the foreign particles-filtered air is discharged.

6. The dust collection unit according to claim 1, wherein a filter assembly is coupled to a lower surface of an upper cover.

7. The dust collection unit according to claim 1, wherein the coupling portion comprises:

a latch protrusion protruded from a push portion;

a rotatable latch hook on which the latch protrusion is latched;

a spring applying a restoring force to the latch hook; and a protruded portion protruded from an inner surface of the exhaust part such that a rotation of the latch is limited.

8. The dust collection unit according to claim 7, wherein the latch hook comprises a plurality of branches, a rotational axis being disposed on one of the branches, the spring being disposed on another one of the branches, the latch hook being latched on another one of the branches, and the protruded portion being latched on another one of the branches.

9. The dust collection unit according to claim 8, wherein the branches are formed integrally with one another.

10. The dust collection unit according to claim 1, wherein a suction hole protruded from a main body of the vacuum cleaner is inserted into an inside of the exhaust part.

11. The dust collection unit according to claim 1, wherein an upper cover is larger than the lower cover.

12. A dust collection unit of a vacuum cleaner, comprising:

a dust collection container collecting foreign particles introduced by a rotational operation of air;

an upper cover shielding an upper side of the dust collection container;

a lower cover shielding a lower side of the dust collection container such that the foreign particles are collected thereon;

a hinge portion connecting the dust collection container and the lower cover such that the lower cover is opened or closed;

a discharge hole through which the air that the foreign particles are filtered by the dust collection container is discharged;

an exhaust part concaved inward from an outer circumferential surface of the dust collection container and formed at an inner portion of the concaved portion; and a coupling portion for selectively latching the lower cover to the dust collection container.

13. The dust collection unit according to claim 12, wherein the coupling portion is formed at a lower side of the discharge hole.

14. The dust collection unit according to claim 12, wherein the coupling portion comprises:

a latch protrusion protruded toward an upper direction of the lower cover; and a latch hook rotating with respect to the dust collection container such that the latch hook is latched on a portion of the latch protrusion to fix the lower cover.

15. The dust collection unit according to claim 14, wherein the latch hook comprises a push portion for releasing a latch between the latch protrusion and the latch hook when a user pushes the push portion downward.

16. The dust collection unit according to claim 14, wherein the dust collection container comprises a protruded portion supporting the latch hook when an external force does not exist.

* * * * *